US006176628B1

(12) United States Patent
Adam et al.

(10) Patent No.: US 6,176,628 B1
(45) Date of Patent: Jan. 23, 2001

(54) PROCESSING PHOTOGRAPHIC MATERIAL

(75) Inventors: Henry H. Adam, Leighton Buzzard; Anthony Earle, Harrow Weald; Leslie R. Wells, Brentford, all of (GB)

(73) Assignee: Eastman Kodak Company, Rochester, NY (US)

( * ) Notice: Under 35 U.S.C. 154(b), the term of this patent shall be extended for 0 days.

(21) Appl. No.: 09/167,204

(22) Filed: Oct. 6, 1998

(30) Foreign Application Priority Data

Oct. 9, 1997 (GB) ..... 9721463

(51) Int. Cl.[7] ..... G03D 3/02
(52) U.S. Cl. ..... 396/626; 396/636
(58) Field of Search ..... 396/617, 620, 396/622, 624, 626, 627, 628, 633, 636, 604, 612

(56) References Cited

U.S. PATENT DOCUMENTS 4,929,975 * 5/1990 Shidara ..... 396/626
5,365,300 11/1994 Wernicke et al. ..... 396/617
5,923,916 * 7/1999 Piccinini, Jr. et al. ..... 396/626

OTHER PUBLICATIONS

Patent Abstracts of Japan, vol. 14, No. 274 (P–1061), Jun. 13, 1990 & JP 02 079841 A (Konica Corp.), Mar. 20, 1990.

* cited by examiner

*Primary Examiner*—D. Rutledge
(74) *Attorney, Agent, or Firm*—Frank Pincelli

(57) ABSTRACT

Apparatus for processing photographic material comprises a succession of processing regions formed by inclined planes extending between sets of rollers. As the material is driven up the planes with its emulsion side down, wash solution flows down beneath it. The length of each plane can be different so that the material is washed for different times in each region, achieving chemical equilibrium in the final region before passing on to the drying stage.

28 Claims, 4 Drawing Sheets

PROCESSING PHOTOGRAPHIC MATERIAL

FIELD OF THE INVENTION

This invention relates to the processing, and particularly but not exclusively the washing or stabilizing, of photographic material, usually already exposed, in which the material passes through a plurality of stages, preferably in a counter-current mode.

BACKGROUND OF THE INVENTION

Photographic material as referred to herein is understood to be generally planar, may comprise film or paper, may produce a black-and-white or color image, and may be in a continuous web form or may comprise discrete sheets.

Silver halide photographic materials are well-known, and are processed to generate a silver or dye image via a development stage followed by a series of baths to stabilize and provide permanence to the image. Such baths convert and remove unwanted materials from the coated photographic layers which would either interfere with the quality of the final image or cause degradation of the image with time. In typical color systems the development stage is followed by a bleach stage to oxidize the developed silver to a form which can be dissolved by a fixing agent in the same or a separate bath. Such silver removal stages are then followed by a washing stage using water, or other wash solution, or a stabilization stage using a stabilizer solution. For convenience, this last-mentioned stage will hereinafter be referred to generically as "washing." Such stages remove residual chemicals and may also include conversion reactions between stabilizer solution components and materials within the coated layers. These stages are required to provide the required degree of permanence to the final image.

In many cases, particularly in small-scale "minilab" or "microlab" equipment, the wash stage is performed in a multi-tank arrangement. Usually the replenishment of this stage, which keeps the concentration of substances removed from the photographic material at a constant and sufficiently low level, is carried out by adding fresh wash solution to the final tank of the sequence and arranging over-flow from the final tank to flow into the previous tank and so on, the overflow from the first tank of this stage being then discarded as effluent. This is referred to as a "counter-current" mode. This arrangement allows significantly lower amounts of solution to be used compared with one or two tanks especially when these are replenished separately.

In all of these arrangements, processing is carried out with the photographic material immersed in a tank of solution, even though many, though not all, photographic materials are sensitized with an emulsion only on one side thereof.

In a modern minilab a typical wash replenishment system might use around 200 $cm^3$ of replenisher per $m^2$ of sensitized material processed in a three or four-tank counter-current arrangement. The time the processed material spends in each tank is typically 20 to 25 seconds during which time an equilibrium is established between the concentration of substances in the coated material and the seasoned (steady-state) concentrations in the wash solution. The total time for this stage typically varies from 60 to over 100 seconds.

U.S. Pat. No. 5,365,300 discloses a process for the treatment of photographic material with a bath containing at least one processing material, in which, after the treatment bath, the photographic material is guided upwards through an ideally preferably vertical compartment which closely surrounds the material which is washed from above by water flowing under gravity in counter-current to the material. The wash water is arranged to carry chemicals off the material into the bath for re-cycling.

It is desirable to process photographic material more rapidly, and in particular to reduce overall wash times by several factors, for example to about 20 seconds as compared to 100 seconds, whilst reducing overall replenishment rates. Reduction of the path-length of the wash section of the process, for example, will shorten the time taken, for a given transportation speed of the material being processed. This latter parameter is usually constrained by the demands of the previous tanks. Unfortunately, simply reducing the number of counter-current tanks involved, while achieving the goal of shorter path-length, would require a significantly increased replenishment rate to achieve the same seasoned concentration (steady-state concentration) in the final tank from which the sensitized material emerges before being introduced to the drying stage.

It is also desirable to minimize the effluent from the processing. This is advantageous not only for the protection of the environment, but also to the operator, especially of mini- and micro-labs, in terms of having less solution for disposal.

SUMMARY OF THE INVENTION

It has been found that by guiding photographic material along inclined surfaces, the total processing time and quantity of processing solution, and thus effluent, can be co-optimized to minimum values.

In accordance with one aspect of the present invention, there is provided apparatus for processing photographic material, comprising a plurality of successive processing regions, each of which is defined by a surface inclined to the horizontal and disposed between a spaced-apart pair of guide means arranged to direct the material from one region to the next over the inclined surface, and means for supplying processing solution to at least one of the regions so that it flows along the associated surface beneath the moving photographic material, thereby to effect the processing.

Preferably, at least one of said guide means comprises a set of rollers through which the photographic material is arranged to pass.

Preferably, the photographic material is driven up the inclined surfaces, with the processing solution flowing down under gravity.

The angle of inclination of the surface to the horizontal is preferably between about 10° and 80°, more preferably between about 30° and 50°, and most preferably is between about 40° and 45°.

It has been found by mathematical modeling that reduction of the time in each processing region may be compensated by optimizing the number of regions, without requiring the achievement of an equilibrium state between the sensitized material and the seasoned (steady-state) condition of every region in the sequence. It is important, however, to achieve this equilibrium in the final region. Thus, advantageously, the length of the inclined surface in at least one of the processing regions is different from that in at least one other of the regions, whereby the residence time of the material is different in each of those regions. Preferably, the length of the inclined surface, and thus the residence time of the material, is longer in the final processing region in the direction of movement of the material than in any one of the preceding regions.

The material may pass substantially unidirectionally, that is to say with respect to the horizontal, through the successive regions, and the inclined surfaces of the regions may extend substantially end-to-end.

Each inclined surface may be substantially planar, and may be at the same angle of inclination. Alternatively, the surface in at least one, and preferably in each, region may be at least partially curved, for example to provide an immersion portion for the photographic material at the beginning of each region.

The processing regions may be all arranged to wash the photographic material, and the apparatus may comprise at least one further stage for performing at least one other processing step. The further stage may comprise a further processing region that extends substantially horizontally adjacent at least one end of said inclined surfaces, preferably in which the material is immersed.

In accordance with a further aspect of the present invention, there is provided a method of processing photographic material, which may be exposed, wherein the material is passed through at least two successive processing regions formed by inclined surfaces between respective spaced-apart guide means, wherein processing solution is supplied to at least one of the surfaces such that it flows beneath the moving material, thereby to effect the processing.

The processing solution is preferably applied only to the underside, the emulsion, or coated side, of the photographic material.

It has been found by mathematical modeling that a reduction of the time that the photographic material resides in each tank can be co-optimized with a significant reduction in the total processing time together with a reduction in the quantity of replenisher used, and thus of the effluent, with little or no loss of performance. This is be achievable with the realization that it is not necessary to reach a state of chemical equilibrium between the coated photographic material and the seasoned (steady-state) condition in every processing region, or tank, in the series. It is, however, important to reach this equilibrium in the final tank, since this level has a significant effect on the finished product.

It will be appreciated that exchange of solution between that contained within the stage and that in the material itself is primarily by a process of diffusion, so that complete equilibrium would occur in an exponential manner only after an infinite time.

The invention provides for effective photographic processing in a much reduced time.

Thus it is possible to devise an apparatus with very short residence times per tank, typically less than 10 seconds, and preferably less than 5 seconds, providing sufficient tanks are used. Thus, for example, both overall short process times for the wash step, less than the conventional 100 seconds, preferably less than 50 seconds, and even less than 25 seconds, as well as reduced replenishment rates. The steady-state seasoned concentration of residual chemicals in the final tank may be as low—or lower than that achieved in a conventional counter-current system. By careful selection of the number of non-equilibrium stages and the time spent in each, it has been found that very large reductions in total wash times can be combined with significant reductions (50% or more) in replenishment rates, when compared with typical current methods. It is possible to achieve these significantly lower over-all wash times whilst maintaining efficient washing and low effluent volumes.

The ability to vary the time spent in successive processing stages, by having inclined surfaces of different lengths for example, avoids the need for a buffer storage between different stages, or the need to vary the chemical activity between the stages, or to vary the speed of transport of the material, when in discrete sheet form.

When small quantities of processing solution are used, evaporation can present a significant problem. With the present invention, however, this can be minimized when, as in preferred embodiments, the emulsion side of the photographic material is arranged to face the surface of the stage through which it is transported. In this way, the material itself acts as a cover to reduce evaporation of the solution.

Some processing solutions have hydrophobic properties, and to encourage a capillary action between the solution and the material to be processed, a thin cover of plastics material may initially be placed over the surfaces, or at least over the first surface of a stage, with the photographic material subsequently being fed underneath.

Reference is made to related commonly owned copending applications disclosing other aspects of photographic processing, U.S. Ser. No. 09/167,611, entitled PROCESSING PHOTOGRAPHIC MATERIAL, by Henry H. Adam et al, filed Oct. 6, 1998; U.S. Ser. No. 09/167,110, entitled PROCESSING PHOTOGRAPHIC MATERIAL, by Anthony Earle et al, filed Oct. 6, 1998; and U.S. Ser. No. 09/167,201, entitled PROCESSING PHOTOGRAPHIC MATERIAL, by Henry H. Adam et al, filed Oct. 6, 1998, all filed concurrently herewith, the entire contents of which are incorporated herein.

BRIEF DESCRIPTION OF THE DRAWINGS

Apparatus for, and methods of processing photographic material, each in accordance with the present invention, will now be described, by way of example, with reference to the accompanying drawings, in which.

DETAILED DESCRIPTION OF THE INVENTION

Figure 1:
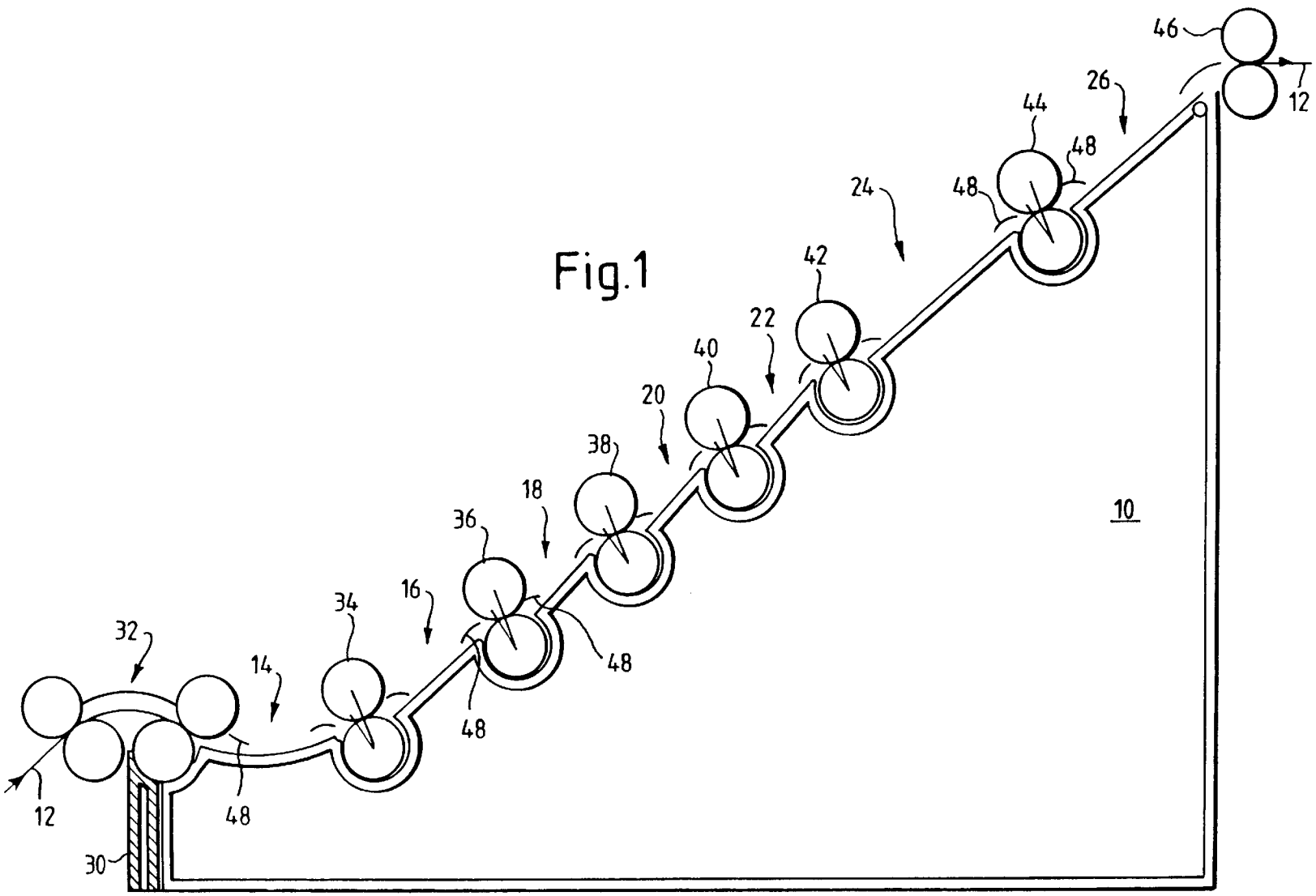
FIG. 1 is a schematic elevation of a first embodiment of the apparatus.

Referring to FIG. 1, the apparatus 10 is arranged to carry out a washing of a continuous strip of exposed photographic film 12 after it has passed through developing, bleaching and fixing stages (not shown). The apparatus 10 has seven stages, comprising an initial horizontal shallow tank stage 14 followed by a sequence of stages 16,18,20,22,24 and 26 that are inclined unidirectionally, upwards as shown, at 45° to the horizontal. Water for washing the film 12 enters the apparatus 10 only through an inlet 28 in the top stage 26, and flows under gravity down through the other stages 24 to 14 and thence into an overflow outlet 30. Each washing stage 14 to 26 is defined by an inclined surface and a set of rubber-covered rollers at each end thereof. The film 12 enters at the bottom of the apparatus 10 through a set of rollers 32 that drive and guide the film down into the wash solution in the first stage 14. The film 12 then passes into the nip of the next pair of rollers 34 from where it is guided with its emulsion side downwards onto the inclined surface of wash stage 16, down which the wash solution is flowing. The film is thus guided and transported up the apparatus 10 passing successively through sets of rollers 36,38,40,42 and 44 of the wash stages 18 to 26. At the upper end of the apparatus, the film is removed by a final pair of rollers 46 and guided to a drying stage (not shown).

It will be appreciated that the film 12 will be immersed in solution in the first stage 14 such that each of its sides will be washed. This is useful when the preceding stage has involved immersion, for example, in a processing tank. Most photographic materials are sensitized only on one surface, however, so that immersion is not required throughout the processing. As the film 12 progresses upwards through each successive inclined stage, it is substantially only the underside that is treated. In the present arrangement, the guiding of the film 12 over the inclined surfaces by the rollers may be enhanced by adjacent guide plates 48 which are positioned and shaped to ensure that the film is urged towards the surfaces. The counter-flowing processing solution then forms a thin layer over which the film 12 is dragged, thus ensuring effective washing.

The film 12 is transported through the apparatus at a substantially constant speed. In order to achieve the required different residence times in the various stages 14 to 26, the inclined surfaces are made of appropriately different lengths. Furthermore, as can be seen, one of each set of rollers 32 to 44, at the beginning of each stage, is counter-sunk in a channel that forms a reservoir for the processing solution flowing down the inclined surfaces. The solution is picked up from the reservoirs on the roller surfaces and is transferred to the film 12 as it moves upwardly through the nips. In this way, the film 12 is substantially constantly in contact with the solution from the time it enters the apparatus through rollers 32 until it leaves the top of uppermost stage 26. In other words, the cross-over time between each stage is substantially zero.

Figure 2:
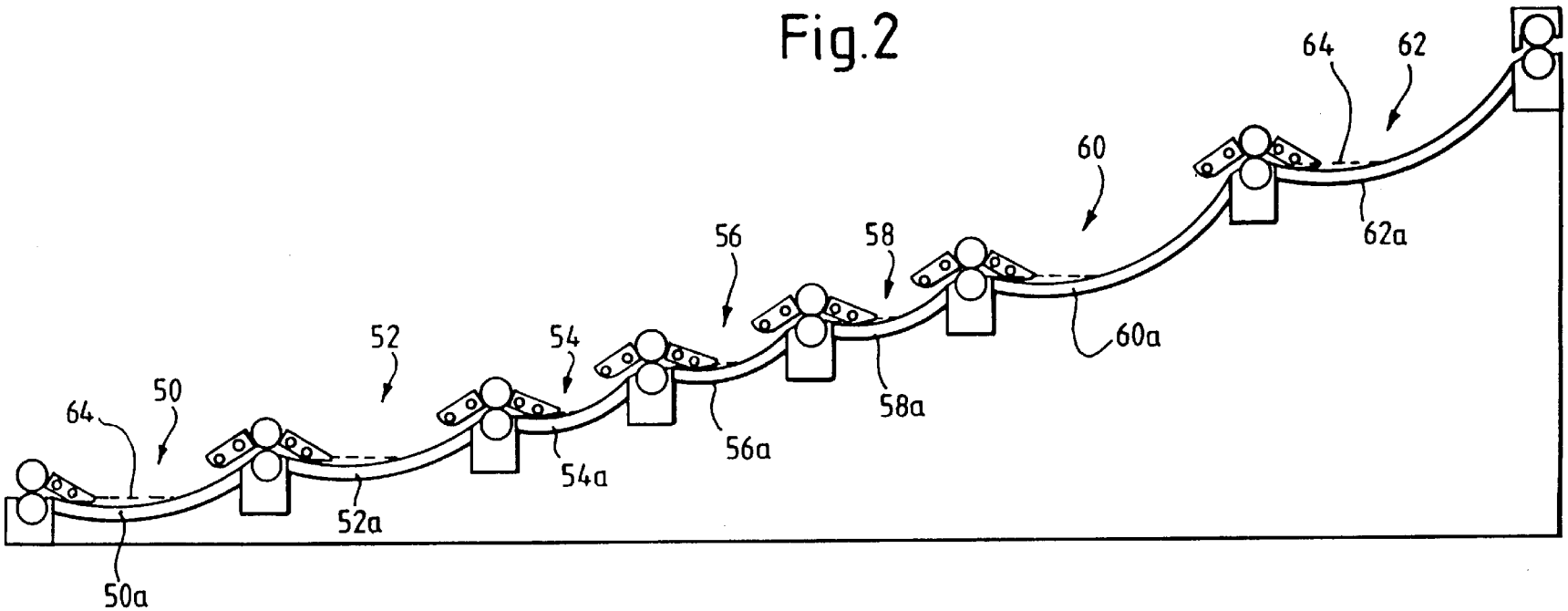
FIG. 2 is a schematic elevation of a second embodiment of the apparatus.

The apparatus 10 of FIG. 1 provides planar surfaces in each of the seven inclined stages. FIG. 2 shows a modified apparatus, in which at least the lower part, suffixed a, of each inclined stage 50,52,54,56,58,60 and 62 is curved to form a shallow trough portion in which the film 12 can be dipped in processing solution 64 before being transported out and upwards. This immersion is effective to wash the upper side of the film 12.

Figure 3:
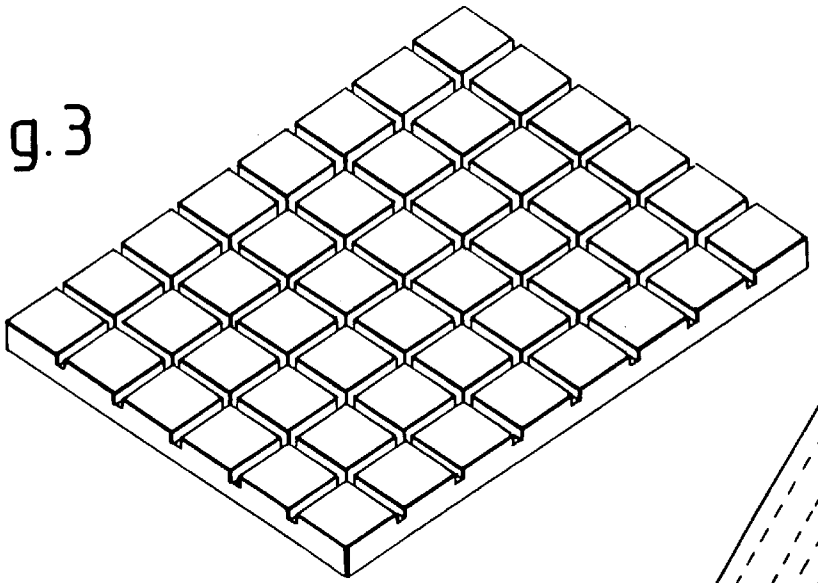
FIGS. 3 to 6 depict various textures of surfaces used in the apparatus of FIGS. 1 and 2.
Figure 4:
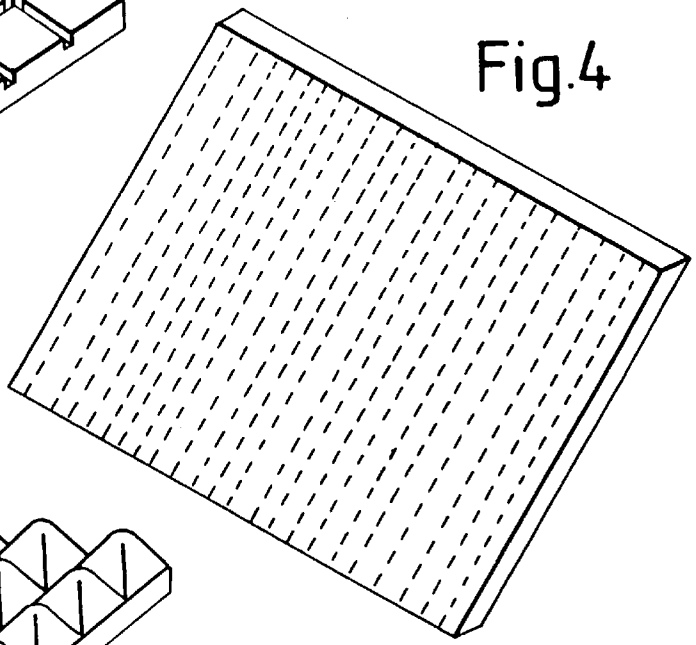
Figure 5:
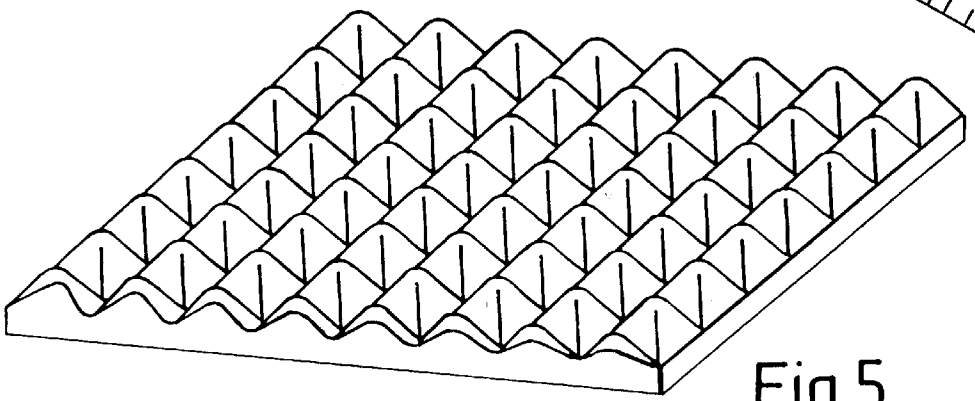
Figure 6:
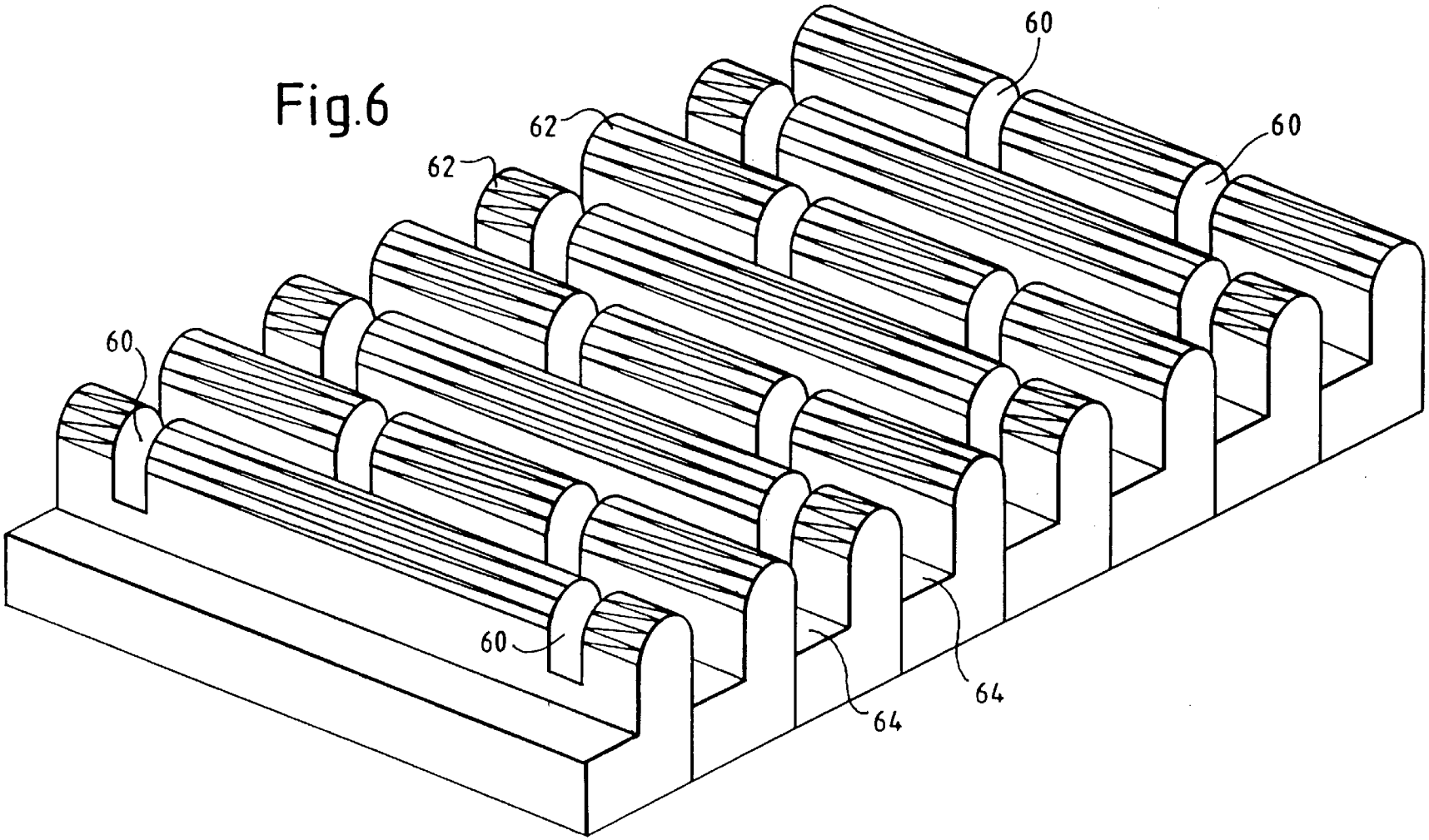

Agitation of the flowing processing solution beneath the moving strip of film can be enhanced by texturing the surfaces of the stages. FIG. 3 shows one example of this, in which part of an inclined surface is indented orthogonally. FIG. 4 shows a surface with random indentations, and in FIG. 5 the surface has a diamond configuration. Other texturing may be applied. In the enlarged view shown in FIG. 6, slots 60 are cut in transversely-extending ribs 62 of the surface. The depth of the troughs 64 between the ribs 62, the number, frequency and width of the slots 60, and their degree of stagger in successive ribs 62, can all be selected to give the required effect on the flow of the solution in the layer beneath the photographic film 12, as well as on the flow rate of replenisher counter-current to the material.

The capillary effect resulting from the photographic material being dragged up an inclined surface down which processing solution is flowing, especially with agitation enhanced by the surface configuration as described above, produces a solution that is substantially homogeneous over the entire surface of each processing region.

It will be appreciated that any one set of rollers may comprise more or fewer than those shown by way of example.

A mathematical model has been developed that takes into account the total wash time, the wash time in each stage, the number of stages, or processing regions or tanks, the replenishment rate, the amount of solution carried over by the photographic material from one stage to the next, and the efficiency of each stage, and has been used to calculate the concentration of processing solution in each tank.

Under typical current operating conditions for washing photographic materials, including a replenishment rate of 18 ml/ft$^2$ for paper and 77.7 ml/ft$^2$ for film, the following results were obtained from the mathematical model:

TABLE 1

| | Total Time (s) | Stage Time (s) | No. of Tanks | Final Conc. (%) |
|---|---|---|---|---|
| Paper | 100 | 25 | 4 | 0.06 |
| Film | 60 | 20 | 3 | 0.10 |

The final concentration is given as a percentage of the concentration of the solution in the material as it enters the first tank.

Restricting the total wash time to 20s, and reducing the replenishment rate to half its former value, the model gives the following results for washing photographic paper:

TABLE 2

| Total Time (s) | Stage Time (s) | No. of Tanks | Final Conc. (%) |
|---|---|---|---|
| 20 | 5 | 4 | 1.7 |
| 20 | 4 | 5 | 1.05 |
| 20 | 3.3 | 6 | 0.76 |
| 20 | 2.86 | 7 | 0.63 |
| 20 | 2.5 | 8 | 0.6 |
| 20 | 2.2 | 9 | 0.63 |
| 20 | 2 | 10 | 0.73 |

It is thus seen that an optimum concentration arises, and is achieved with 8 tanks, but that the final concentration value is ten times that currently available with conventional washing process, and is thus unacceptable.

However, if, in accordance with the present invention, the residence time of the material is allowed to vary from one stage to another, acceptable optimization can be achieved. The following table illustrates this for a seven tank system, with a total wash time of 20s and a replenishment rate of 9 ml/ft$^2$, with the stage times given in seconds:

TABLE 3

| Tank | Time | Time | Time | Time | Time | Time | Time | Time |
|---|---|---|---|---|---|---|---|---|
| 1 | 2.86 | 4.00 | 5.00 | 4.00 | 3.00 | 3.00 | 2.00 | 2.00 |
| 2 | 2.86 | 3.00 | 3.00 | 4.00 | 3.00 | 3.00 | 2.00 | 2.00 |
| 3 | 2.86 | 2.00 | 2.00 | 2.00 | 2.00 | 1.00 | 1.00 | 2.00 |
| 4 | 2.86 | 2.00 | 2.00 | 2.00 | 2.00 | 1.00 | 1.00 | 2.00 |
| 5 | 2.86 | 2.00 | 2.00 | 2.00 | 2.00 | 1.00 | 1.00 | 2.00 |
| 6 | 2.86 | 3.00 | 3.00 | 2.00 | 4.00 | 5.00 | 5.00 | 2.00 |
| 7 | 2.86 | 4.00 | 3.00 | 4.00 | 4.00 | 6.00 | 8.00 | 8.00 |
| Conc | 0.64 | 0.31 | 0.64 | 0.35 | 0.25 | 0.10 | 0.07 | 0.07 |

As can be seen from Table 3, the concentration achieved in the final tank is very dependent on the distribution of times between the tanks. With an equal distribution for comparison, the first column under theses conditions gives an unacceptable final concentration of 0.64%. However, an acceptable final tank concentration of 0.07%, comparable to that obtained with current operating conditions of 100 seconds total wash time and 18 ml/ft$^2$, is achievable by suitable time variation, as shown in the last two columns. As can be seen in particular from the last column, the final tank is the important one, and it can be shown that substantially equilibrium has been obtained therein, even though not in any of the preceding tanks. It will be appreciated that by suitable selection of the number of tanks and distribution of residence times, it may be possible to reduce further the final concentration for a given total wash time and replenishment rate, which parameters themselves may be further optimized. The concentration in the final tank will be the concentration of residual chemicals in the coated photographic material as it passes to the subsequent drying stage, and will thus be representative of the quantity or level of unwanted chemicals remaining in the final product.

It is to be understood that various other changes and modifications may be made without departing from the scope of the present invention, the present invention being limited by the following claims.

What is claimed is:

1. Apparatus for processing photographic material, comprising a plurality of successive processing regions, each of which is defined by a surface inclined to the horizontal and disposed between a spaced-apart pair of guide means arranged to direct the material from one region to the next over the inclined surface, at least part of the surfaces being curved such that both sides of the material are subject to the processing solution and means for supplying processing solution to at least one of the regions so that it flows along the associated surface beneath the moving photographic material, thereby effecting processing.

2. Apparatus according to claim 1, wherein at least one of said guide means comprises a set of rollers through which the photographic material is arranged to pass.

3. Apparatus according to claim 1, wherein the solution is arranged to flow from one, preferably an upper one, of the regions past an associated guide means into an adjacent processing region.

4. Apparatus according to claim 1, wherein the processing solution is supplied to one end, preferably the uppermost end, of the inclined surfaces.

5. Apparatus according to claim 1, wherein the material is driven up the inclined surfaces.

6. Apparatus according to claim 1, wherein the length of the inclined surface in at least one of the processing regions is different from that in at least one other of the regions, whereby the residence time of the material is different in each of those regions.

7. Apparatus according to claim 1, wherein the length of the inclined surface is longer in the final processing region in the direction of movement of the material than in any one of the preceding regions.

8. Apparatus according to claim 7, wherein the length of the inclined surface in each of said preceding processing regions is substantially equal.

9. Apparatus according to claim 1, wherein the speed at which the material is driven and the length of the inclined surfaces in the processing regions is such that the residence time of the material in at least one of the regions is less than 10 seconds, and is preferably less than seconds.

10. Apparatus according to claim 1, wherein the speed at which the material is driven and the length of the inclined surfaces in the processing regions is such that the total residence time of the material in all the regions is less than 100 seconds, preferably less than 50 seconds, and most preferably not more than 25 seconds.

11. Apparatus according to claim 1, wherein the inclined surfaces of the regions extend substantially end-to-end.

12. Apparatus according to claim 1, wherein the inclined surface in at least one of the processing regions is textured so as to provide agitation of the processing solution.

13. Apparatus according to claim 1, wherein the processing solution flowing through at least some, and preferably all, of the regions is wash solution.

14. Apparatus according to claim 1, wherein all of said processing regions are arranged to perform one processing step on the material, and wherein the apparatus comprises at least one further stage for performing at least one other processing step.

15. Apparatus according to claim 14, wherein the further stage comprises a further processing region that extends substantially horizontally adjacent at least one end of said inclined surfaces, preferably in which the material is immersed.

16. Apparatus according to claim 15, wherein the processing solution supplied to the material in the further processing stage is substantially the same as that supplied in the inclined processing regions.

17. A method of processing photographic material, wherein the material is passed through at least two successive processing regions formed by inclined surfaces between spaced-apart guide means, at least part of one of the surfaces being curved such that both sides of the material are subject to processing solution, the processing solution being supplied to at least one of the surfaces such that it flows beneath the moving material, thereby to effect the processing.

18. A method according to claim 17, wherein the processing solution is supplied to one, preferably an upper one, of the regions, and is arranged to flow into an adjacent region.

19. A method according to claim 17, wherein processing solution is supplied to the material as the material passes in contact with the guide means.

20. A method according to claim 17, wherein the material and the solution move along the inclined surfaces in opposing directions, preferably with the material moving up the surfaces.

21. A method according to claim 17, wherein processing solution is applied substantially only to the underside of the material.

22. A method according to claim 17, wherein the time that the material resides in at least one of the processing regions is different from the time it resides in at least one other of the regions.

23. A method according to claim 22, wherein the time that the material resides in the final processing region in its direction of movement is longer than in any one of the preceding regions.

24. A method according to claim 17, wherein the residence time of the material in at least one of the processing regions is less than 10 seconds, and is preferably less than 5 seconds.

25. A method according to claim 17, wherein the total residence time of the material in all the processing regions is less than 100 seconds, preferably less than 50 seconds, and most preferably is not more than 25 seconds.

26. A method according to claim 17, wherein the processing is effective to wash the photographic material.

27. A method according to claim 17, wherein prior to and/or after the said processing, at least one other processing step is performed on the material, preferably by immersing the photographic material in processing solution.

28. A method according to claim 27, wherein the processing solution of said other processing step is substantially the same as that supplied to the inclined processing regions.

* * * * *

UNITED STATES PATENT AND TRADEMARK OFFICE

CERTIFICATE OF CORRECTION

PATENT NO. : 6,176,628 B1
DATED : January 23, 2001
INVENTOR(S) : Henry H. Adam, et al.

It is certified that error appears in the above-identified patent and that said Letters Patent is hereby corrected as shown below:

Column 7, claim 9,
Line 54, after "less than" insert -- 5 --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*